US012729609B2

(12) United States Patent
Espinoza

(10) Patent No.: US 12,729,609 B2
(45) Date of Patent: Sep. 8, 2026

(54) PERFORATOR TOOL

(71) Applicant: WILDCAT OIL TOOLS, LLC, Midland, TX (US)

(72) Inventor: Jaime Espinoza, Floresville, TX (US)

(73) Assignee: WILDCAT OIL TOOLS, LLC, Midland, TX (US)

( * ) Notice: Subject to any disclaimer, the term of this patent is extended or adjusted under 35 U.S.C. 154(b) by 0 days.

(21) Appl. No.: 18/964,309

(22) Filed: Nov. 29, 2024

(65) Prior Publication Data

US 2026/0153017 A1 Jun. 4, 2026

(51) Int. Cl.
*E21B 43/114* (2006.01)
*E21B 43/119* (2006.01)

(52) U.S. Cl.
CPC ..... *E21B 43/114* (2013.01); *E21B 43/119* (2013.01)

(58) Field of Classification Search
CPC ..... E21B 43/114; E21B 43/119; E21B 43/11
See application file for complete search history.

(56) References Cited

U.S. PATENT DOCUMENTS 4,050,529 A * 9/1977 Tagirov ..... E21B 43/114 166/100
4,499,951 A * 2/1985 Vann ..... E21B 43/1185 175/4.54
6,189,618 B1 * 2/2001 Beeman ..... E21B 37/00 166/194
8,066,059 B2 * 11/2011 Ferguson ..... E21B 43/114 166/194
8,448,700 B2 5/2013 Connell et al.
2001/0045282 A1 * 11/2001 Robinson ..... E21B 29/06 166/117.6
2006/0201675 A1 * 9/2006 Ferguson ..... E21B 34/10 166/298
2012/0031615 A1 * 2/2012 Connell ..... E21B 43/114 166/55
2015/0144342 A1 5/2015 Schultz et al.
2016/0053592 A1 2/2016 Getzlaf et al.
2018/0252078 A1 * 9/2018 Schultz ..... E21B 34/10

* cited by examiner

*Primary Examiner* — Daniel P Stephenson
(74) *Attorney, Agent, or Firm* — HULSEY P.C.

(57) ABSTRACT

A perforator tool including perforation nozzles, and bypass holes connecting to a bypass flow channel is disclosed. The perforator tool includes a first piston and a second piston positioned within the tubular body. The second piston positions below the first piston. A mixture of water, a chemical additive, and sand is introduced via an inlet to flow out through an outlet via the first piston and the second piston defining a first flow path. Further, a first fluid blocking member is dropped through the first piston to seat said second piston for opening the perforation nozzles to perforate a wellbore with the mixture. Further, a second fluid blocking member is dropped over the first piston to seat the first piston such that the bypass flow channel is in fluid communication with the inlet to direct said mixture to said outlet defining a second flow path.

13 Claims, 4 Drawing Sheets

PERFORATOR TOOL

BACKGROUND OF THE INVENTION

Field of the Invention

The present invention relates to the oil and gas production industry, and in particular, relates to a perforator tool used for perforating wells in coiled tubing technologies.

Description of the Prior Art

It is known that sand jet perforation is used in the oil and gas industry to create perforations in a wellbore casing to allow hydrocarbons to flow from the formation into the wellbore. The perforations are created as the drilling process causes damage to the formation adjacent to the well. The damage limits the pores through which the oil or gas would flow. Typically, the sand jet perforation involves injecting a mixture of water and fine sand with abrasive sand particles into the wellbore at a high pressure. The high-pressure jet erodes the casing and cement and creates perforations.

Several perforator tools used for sand perforating operations have been disclosed in the past. One such example is disclosed in a United States Granted U.S. Pat. No. 8,448,700, entitled "Abrasive perforator with fluid bypass" ("the '700 Patent"). The '700 Patent discloses an abrasive perforator tool with a bypass flow channel. The tool comprises a tubular body or housing with perforating nozzles in the sidewall. A sleeve assembly inside the central bore of the tool provides for sequential deployment of first and second sleeves. Prior to deployment of the sleeve assembly, pressurized fluid can be passed through the tool to operate other tools beneath the perforator in the bottom hole assembly. Deployment of the first sleeve diverts pressurized fluid through the nozzles for perforating. Deployment of the second sleeve redirects the pressurized flow through the outlet of the tool to resume operation of other tools below the perforator.

Another example is disclosed in a U.S. Publication No. 20150144342, entitled "Downhole bypass tool" ("the '342 Publication"). The '342 Publication discloses a downhole bypass tool that includes an inlet for receiving fluid into a housing of the bypass tool. The bypass tool also includes a flow directing apparatus disposed in the housing for directing fluid to flow into an operational flow path of a vibratory tool. The vibratory tool is at least partially disposed within the housing of the bypass tool. The flow directing apparatus operates selectively bypass the operational flow path of the vibratory tool such that the fluid bypasses the operational flow path of the vibratory tool and flows out of an outlet of the bypass tool.

Another example is disclosed in a U.S. Publication No. 20160053592, entitled "Apparatus and method for abrasive jet perforating" ("the '592 Publication"). The '592 Publication discloses a perforating tool comprising a housing, an inlet defined within the housing, a perforator fluid passage defined within the housing, and disposed in fluid communication with the inlet, and a nozzle, press-fit into the housing, and disposed in fluid communication with the perforator fluid passage.

Although the above discussed disclosures are useful, they still have problems and present incomplete solutions. For example, the perforator tools block the flow of mixture to below tools. Blocking the sand and water mixture in a wellbore perforation tool can significantly impact the effectiveness of the perforation process and affect the flow of the mixture to bottom hole tools.

Therefore, there is a need in the art to provide an improved perforator tool for perforating wells.

SUMMARY OF THE INVENTION

It is an object of the present invention to provide an improved perforator tool for perforating wells.

It is another object of the present invention to provide a perforator tool that allows pressurized fluid to flow through prior to perforating to carry out wellbore operations, or operate other fluid driven tools such as motors below the perforator tool, or both without having to withdraw a tool string. The tool string indicates a series of interconnected components positioned to deliver the high-pressure sand and water mixture to the wellbore and create perforations.

In order to achieve one or more objects, the present invention provides a perforator tool including perforation nozzles, and bypass holes connecting to a bypass flow channel. The perforator tool includes a first piston and a second piston positioned within the tubular body. The second piston positions below the first piston. A mixture of water, a chemical additive, and sand is introduced via an inlet to flow out through an outlet via the first piston and the second piston defining a first flow path. Further, a first fluid blocking member is dropped through the first piston to seat said second piston for opening the perforation nozzles to perforate a wellbore with the mixture. Further, a second fluid blocking member is dropped over the first piston to seat the first piston such that the bypass flow channel is in fluid communication with the inlet to direct said mixture to said outlet defining a second flow path.

In one advantageous feature of the present invention, the perforator tool allows the operation of downhole tools, such as motors, before and after the perforation process without the need to withdraw the tool string. In other words, the perforator tool enables continuous wellbore operations without withdrawing the tool string. Operators can maintain fluid flow and operate motors below the perforator tool throughout the perforation process, reducing downtime and operational complexity.

In another advantageous feature of the present invention, the bypass flow channel allows for a higher flow rate of the perforation fluid.

These and other objects of the present subject matter will be apparent from review of the following specification and the accompanying drawings.

DETAILED DESCRIPTION OF THE PREFERRED EMBODIMENT

Figure 1:
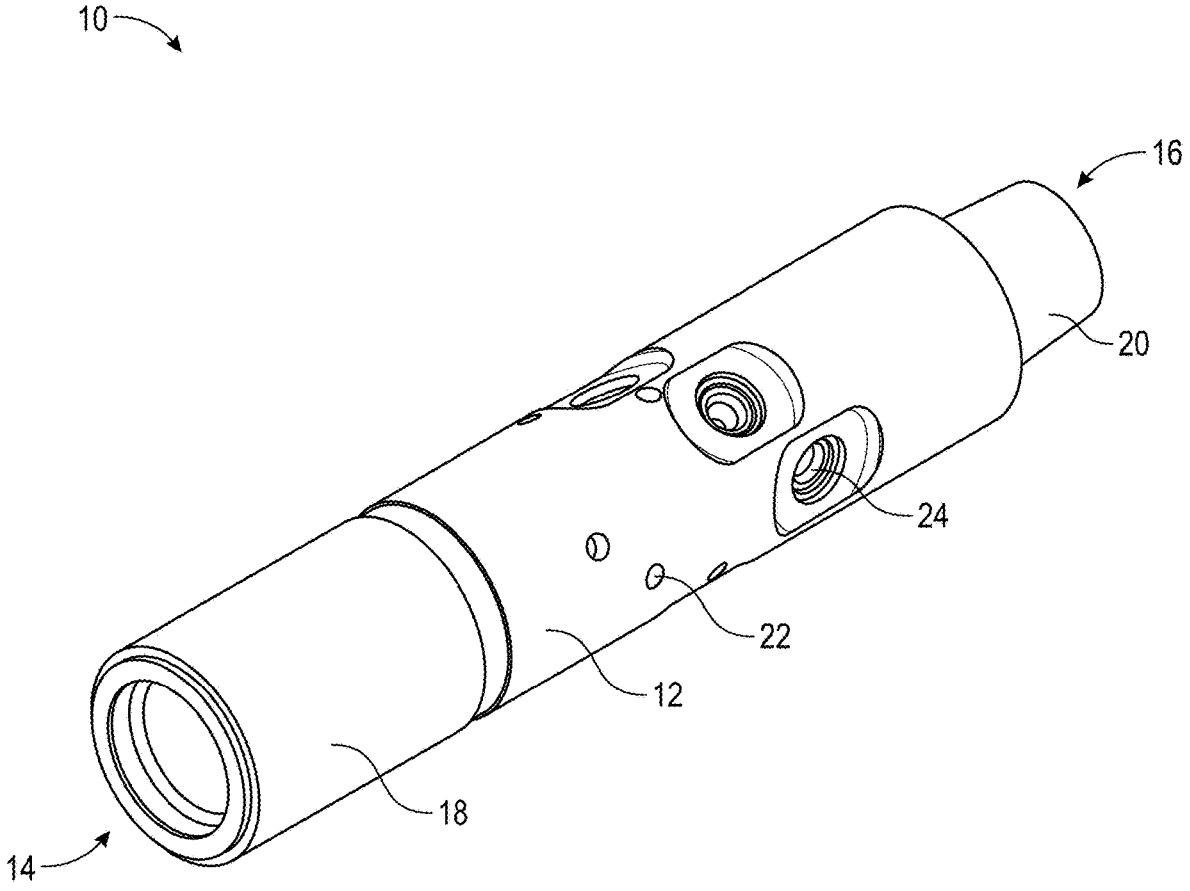
FIG. 1 illustrates a perspective view of a perforator tool, in accordance with one embodiment of the present invention.

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed perforator tool. However, it will be apparent to those skilled in the art that the presently disclosed invention may be practiced without these specific details. In some instances, well-known structures and devices are shown in functional or conceptual diagram form in order to avoid obscuring the concepts of the presently disclosed perforator tool.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

It will be understood that, although the terms first, second, third, etc. may be used herein to describe various elements, components, regions, and/or sections, these elements, components, regions, and/or sections should not be limited by these terms. These terms are only used to distinguish one element, component, region, and/or section from another element, component, region, and/or section.

It will be understood that the elements, components, regions, and sections depicted in the figures are not necessarily drawn to scale.

Although the present invention provides a description of a perforator tool, it is to be further understood that numerous changes may arise in the details of the embodiments of the perforator tool. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

Various features and embodiments of a perforator tool are explained in conjunction with the description of FIGS. 1-4.

FIG. 1 shows a perspective view of a perforator tool 10, in accordance with one embodiment of the present invention. Perforator tool 10 is also referred to as sand perforator tool or abrasive perforator tool. Perforator tool 10 includes a tubular body 12. Tubular body 12 presents a first end 14 and a second end 16. Tubular body 12 includes a first connector 18 and a second connector/sleeve 20. Here, first connector 18 indicates a top connector and second connector/sleeve 20 indicates a bottom connector. Further, tubular body 12 presents a plurality of perforation nozzles 22 along its sidewall. In one example, plurality of perforation nozzles 22 includes six (6) perforation nozzles, each having a size of 0.125 inch. Further, tubular body 12 encompasses a plurality of bypass holes 24. Plurality of bypass holes 24 includes three (3) bypass holes 24, each having a size of 0.219 inch.

Figure 2:
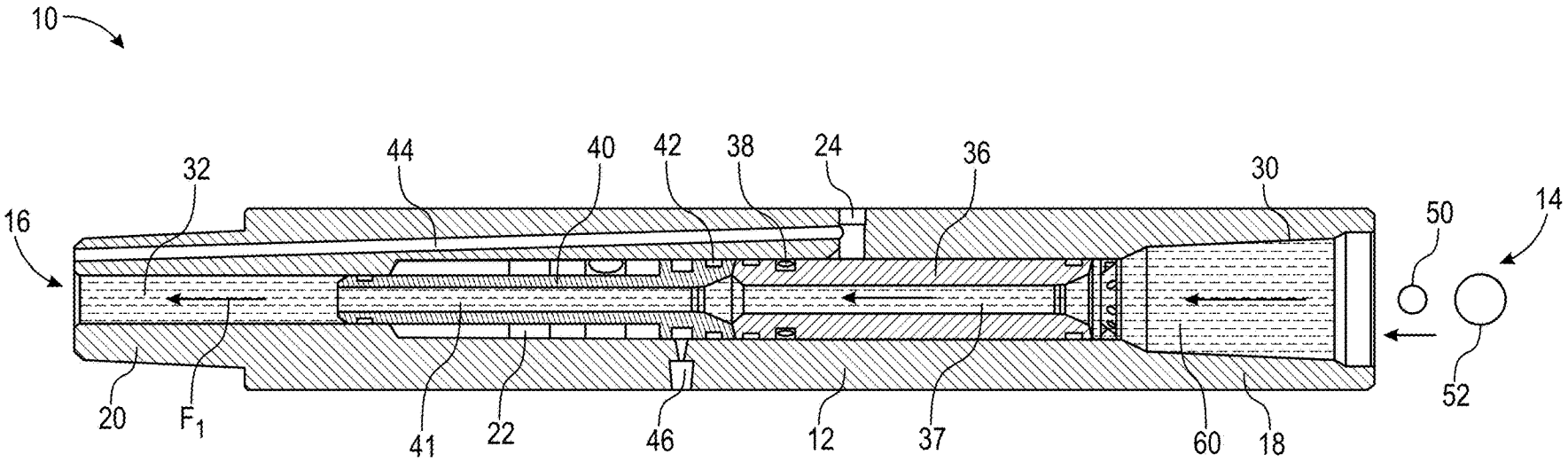
FIG. 2, FIG. 3 and FIG. 4 illustrate cross-sectional views of the perforator tool, in accordance with one embodiment of the present invention.
Figure 3:
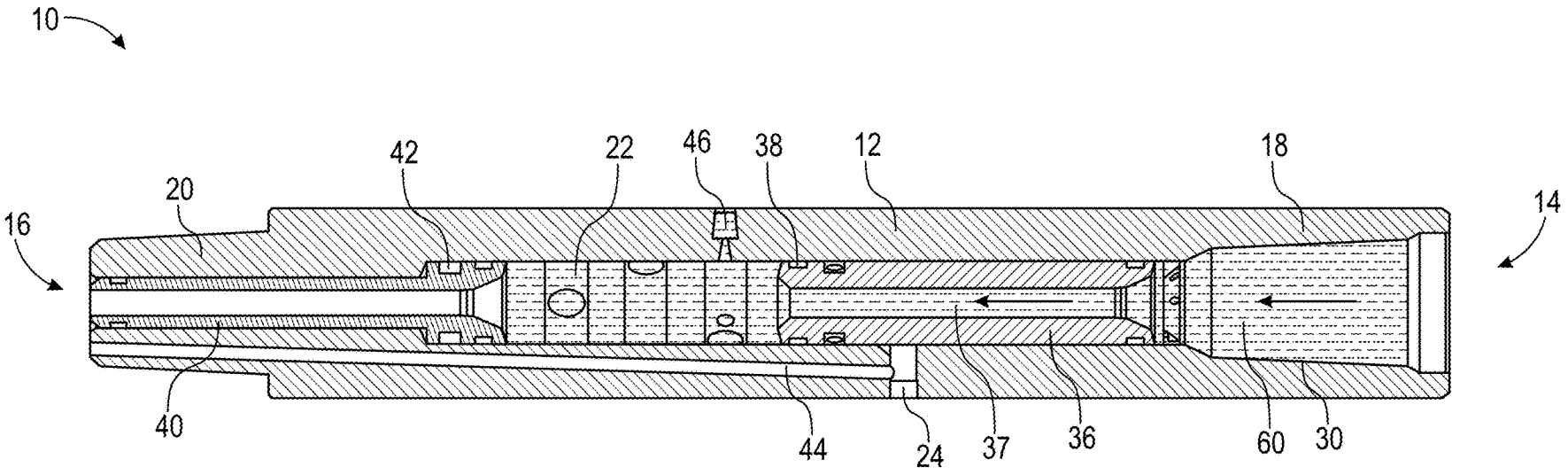
Figure 4:
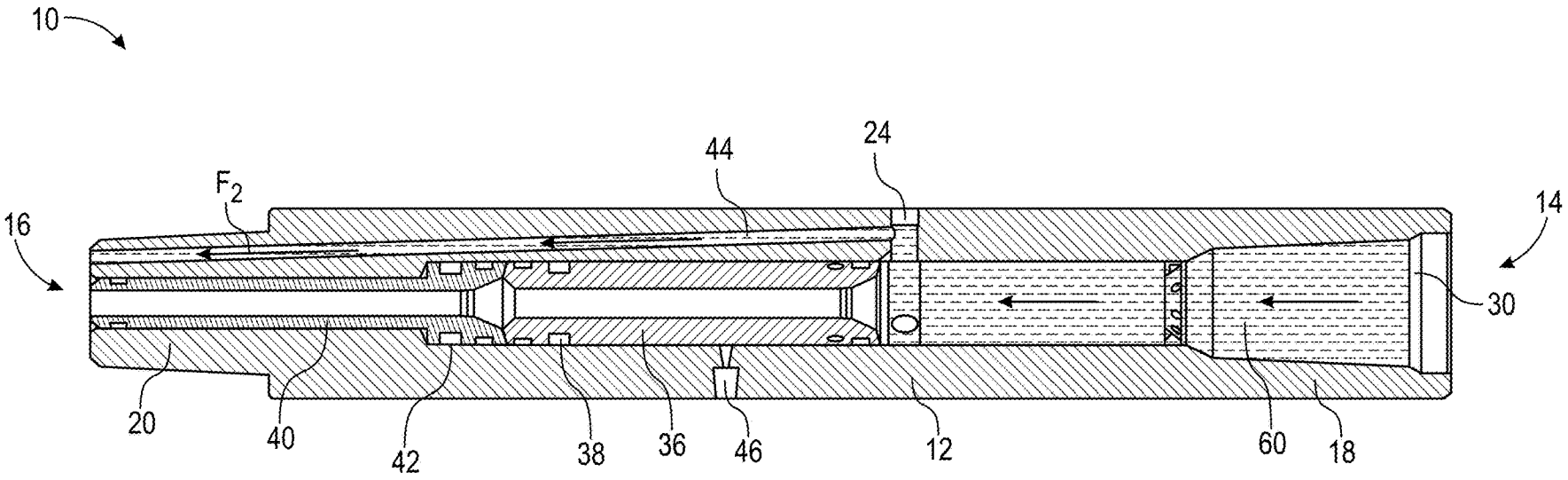

Now referring to FIG. 2, FIG. 3 and FIG. 4, cross-sectional views of sand perforator 10 in operation is shown, in accordance with one embodiment of the present invention. FIG. 2 shows the feature of perforator tool 10 in an open configuration. As can be seen, tubular body 12 includes an inlet 30 and an outlet 32. Inlet 30 and outlet 32 present a first flow path $F_1$ (with pistons 36, 40) allowing an abrasive fluid 60 to pass through in the open configuration. In this configuration, inlet 30 connects to a first piston 36. First piston 36 encompasses a first channel 37. First channel 37 indicates the internal diameter of first piston 36 allowing passage of mixture 60. In one example, first channel 37 has a diameter of 0.535 inch. First piston 36 presents a first set screws 38. In one example, first set screws 38 indicate O-rings that are positioned around first piston 36 at its distal end (i.e., opposite end of inlet 30 facing second piston 40). Further, tubular body 12 includes a second piston 40 having a second channel 41. Second channel 41 indicates the internal diameter of second piston 40 allowing passage of mixture 60. In one example, second piston 40 has a diameter of 0.42 inch. Second piston 40 includes a second set screws 42. In one example, second set screws 42 indicate O-rings that are positioned around second piston 40 at one end (facing first piston 36). In the open configuration, second piston 40 positions alongside perforation nozzles 22, and second piston 40 positions adjacent to first piston 36.

Further, tubular body 12 includes a bypass flow channel 44. Bypass flow channel 44 is formed within the sidewalls of tubular body 12 (extending onto second connector/sleeve 20) interfacing bypass holes 24. In one example, bypass flow channel 44 is tapered inwards i.e., towards outlet 32. Furthermore, tubular body 12 includes an annulus 46.

Now referring to FIG. 2, the operation of perforator tool 10 in the open configuration is explained. Prior to sand perforation, say about 30 minutes prior, an operator prepares a mixture 60 of sand, chemical additive, and fluid (water). Mixture 60 contains fresh water, a fluid additive such as FR, and sand. In one example, mixture 60 contains ½ to ¾ lbs of sand per gallon of fluid. The fluid mixture is 4% gallon FR per barrel (42 gallons) of fresh water. Mixture 60 is made to flow from first end 14 to second end 16. Here, mixture 60 flows through a first flow path $F_1$ i.e., inlet 30, first channel 37, second channel 41 and outlet 32, and onto a motor/another downhole tool (not shown) below. In one example, mixture 60 has a total flow area (TFA) of 0.138.

Subsequently, a first fluid blocking member 50 having a size smaller than a second fluid blocking member 52 is dropped into a tool string. Each of first fluid blocking member 50 and second fluid blocking member 52 indicates balls when pumped down through inlet 30 contacts a seat of second piston 40, and first piston 36, respectively and prevent fluid from flowing through their respective second channel 41, and first channel 37. Here, the tool string refers to a series of interconnected components positioned within tubular body 12 to deliver the high-pressure sand and water mixture to the wellbore and create perforations.

In the present embodiment, first fluid blocking member 50 has a size of ½ inch and second fluid blocking member 52 has a size of ⅝ inch. FIG. 2 shows the feature of first fluid blocking member 50 and second fluid blocking member 52 aligned with perforator tool 10, prior to dropping them into perforator tool 10. First fluid blocking member 50 drops into the tool string. As specified above, the tool string indicates a series of interconnected components positioned to deliver the high-pressure sand and water mixture to the wellbore and create perforations. Now referring to FIG. 3, first fluid blocking member 50 drops at a pressure of 4500 to 5500 pounds per square inch (psi) through first channel 37 (having a diameter of 0.535 inch) of first piston 36 and seats second piston 40 at the pressure of 4500 to 5500 psi such that second piston 40 shears second set screws 42 to open perforation nozzles 22. At this time (upon shearing, second piston 40 enters outlet 32), the operator recognizes a significant drop in pressure indicating that the mixture 60 is flowing through perforation nozzles 22 and is pumping through annulus 46, as shown in FIG. 3.

Subsequently, the operator pumps 30 barrels per 6 holes at 3 barrels per minute of mixture 60. If perforator tool 10 has less than 6 holes, then the operator pumps 5 barrels per hole at 3 barrels per minute.

Once the target area is perforated, a second fluid blocking member 52 that is larger than first fluid blocking member 50 is introduced into the tool string. As specified above, first fluid blocking member 50 has a size of ½ inch and second fluid blocking member 52 has a size of ⅝ inch. When second fluid blocking member 52 is dropped into the tool string, second fluid blocking member 52 contacts first piston 36 and causes it to shift down. Further, first set screws 38 on first piston 36 shear at approximately 4500 to 5500 psi returning the flow back to the motor (not shown, or downhole tool) positioned below via bypass flow channel 44 formed at bypass holes 24. When first piston 36 shifts down, this creates a fluid communication between inlet 30 and bypass flow channel 44, and mixture 60 flows through a second flow path $F_2$ as indicated in FIG. 4 (the bypass flow of mixture 60). In one example, mixture 60 has a total flow area (TFA) of 0.113 while flowing through second flow path $F_2$ indicating that mixture 60 flows at higher flow rate even through second flow path $F_2$.

In the present invention, perforator tool 10 helps to regain fluid flow at a higher rate through bypass flow channel 44 even after perforating. This allows a thorough cleanout of the well and allows it to operate the motor below perforator tool 10 after completing the perforating operation without withdrawing the tool string. Further, the present invention allows pressurized fluid to flow through prior to perforating to carry out wellbore operations, or operate other fluid driven tools such as motors below perforator tool 10, or both without having to withdraw the tool string.

A person skilled in the art appreciates that the perforator tool can come in a variety of shapes and sizes depending on the need and comfort of the user. Further, many changes in the design and placement of components may take place without deviating from the scope of the presently disclosed perforator tool.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A perforator tool, comprising:

a tubular body comprising a wellbore having an inlet and outlet, wherein said tubular body comprises perforation nozzles and bypass holes, wherein said bypass holes extend perpendicularly from said wellbore, wherein said bypass holes comprises a bypass flow channel, wherein said bypass flow channel extends from said bypass holes at an inclined angle with respect to a longitudinal axis of said wellbore towards said outlet;

a first piston positioned within said tubular body; and a second piston positioned within said tubular body, wherein said first piston comprises a first channel formed within said first piston, wherein said first piston comprises first set screws, wherein said second piston comprises a second channel formed within said second piston, wherein said second piston comprises second set screws, wherein said second piston positions below said first piston, wherein a mixture is introduced via said inlet to flow out through said outlet via said first piston and said second piston defining a first flow path, wherein said first channel and said second channel allow the flow of said mixture in said first flow path, wherein a first fluid blocking member is dropped through said first piston to seat said second piston for opening said perforation nozzles to perforate a wellbore with said mixture, wherein said second set screws shear upon coming in contact with said first fluid blocking member causing said second piston to enter said outlet, and wherein a second fluid blocking member is dropped over said first piston to seat said first piston such that said inlet is in in-fluid communication with said bypass flow channel to direct said mixture defining a second flow path, wherein said first set screws shear upon coming in contact with said second fluid blocking member enabling said fluid communication between said inlet and said bypass flow channel at said outlet.

2. The perforator tool of claim 1, wherein said second set screws are formed around said second piston at one end facing said first piston.

3. The perforator tool of claim 1, wherein said first set screws are formed around said first piston at one end facing said second piston.

4. The perforator tool of claim 1, wherein said second fluid blocking member is larger than said first fluid blocking member.

5. The perforator tool of claim 1, wherein said mixture comprises water, a chemical additive, and sand.

6. A perforator tool, comprising:

a tubular body comprising a wellbore having an inlet and outlet, wherein said tubular body comprises perforation nozzles and bypass holes, wherein said bypass holes extend perpendicularly from said wellbore, wherein said bypass holes comprises a bypass flow channel, wherein said bypass flow channel extends from said bypass holes at an inclined angle with respect to a longitudinal axis of said wellbore towards said outlet;

a first piston and a second piston positioned within said tubular body;

a first fluid blocking member; and a second fluid blocking member, wherein a mixture is introduced via said inlet to flow out through said outlet via said first piston and said second piston defining a first flow path, and wherein said first fluid blocking member and said second fluid blocking member are dropped over said first piston and said second piston to enable fluid communication between said inlet and said bypass flow channel to direct said mixture to said outlet defining a second flow path, wherein said first fluid blocking member is dropped through said first piston to seat said second piston for opening said perforation nozzles to perforate said wellbore with said mixture, wherein said second fluid blocking member is dropped over said first piston to seat said first piston such that said inlet is in fluid communication with said bypass flow channel.

7. The perforator tool of claim 6, wherein said second fluid blocking member is larger than said first fluid blocking member.

8. The perforator tool of claim 6, wherein said first piston comprises a first channel formed within said first piston, wherein said second piston comprises a second channel formed within said second piston, and wherein said first channel and said second channel form said first flow path with said inlet and said outlet.

9. The perforator tool of claim 8, wherein said second piston comprises second set screws formed around said second piston at one end facing said first piston, and wherein said second set screws shear upon coming in contact with said first fluid blocking member causing it to enter said outlet.

10. The perforator tool of claim 9, wherein said first piston comprises first set screws formed around said first piston at one end facing said second piston, and wherein said first set screws shear upon coming in contact with said second fluid blocking member enabling said fluid communication between said inlet and said bypass flow channel.

11. The perforator tool of claim 6, wherein said mixture comprises water, a chemical additive, and sand.

12. A method of providing a perforator tool, said method comprising the steps of:

providing a tubular body comprising a wellbore having an inlet and an outlet, said tubular body further comprising perforation nozzles and bypass holes, said bypass holes providing a bypass flow channel, said bypass holes extending perpendicularly from said wellbore, said bypass flow channel extending from said bypass holes at an inclined angle with respect to a longitudinal axis of said wellbore towards said outlet;

providing a first piston and a second piston positioned within said tubular body;

providing a first fluid blocking member, and a second fluid blocking member;

introducing a mixture via said inlet to flow out through said outlet via said first piston and said second piston defining a first flow path; and dropping said first fluid blocking member and said second fluid blocking member over said first piston and said second piston to enable fluid communication between said inlet and said bypass flow channel to direct said mixture to said outlet defining a second flow path, said first fluid blocking member being dropped through said first piston to seat said second piston for opening said perforation nozzles to perforate said wellbore with said mixture, said second fluid blocking member being dropped over said first piston to seat said first piston such that said inlet is in fluid communication with said bypass flow channel.

13. The method of claim 12, further comprising:

providing said second fluid blocking member having a size larger than said first fluid blocking member, and dropping said first fluid blocking member through said first piston to seat said second piston for opening said perforation nozzles to perforate said wellbore with said mixture.

* * * * *